US005975980A

United States Patent [19]

Whiteneck

[11] Patent Number: 5,975,980

[45] Date of Patent: Nov. 2, 1999

[54] HAND MANIPULATED EATING TOY

[76] Inventor: Joline Whiteneck, 326 33rd Ave., Santa Cruz, Calif. 95062

[21] Appl. No.: 09/133,066

[22] Filed: Aug. 12, 1998

[51] Int. Cl.[6] ..... A63H 3/14; A63H 3/24; A63H 3/02

[52] U.S. Cl. ..... 446/327; 446/73; 446/304; 446/369; 446/329

[58] Field of Search ..... 446/72–76, 296, 446/304, 305, 369, 327, 328, 329, 475

[56] References Cited

U.S. PATENT DOCUMENTS

| | | |
|---|---|---|
| 1,641,175 | 9/1927 | Lemieux . |
| 1,660,085 | 2/1928 | Nassau . |
| 4,244,142 | 1/1981 | Crawford . |
| 5,580,292 | 12/1996 | Gaportsin . |

*Primary Examiner*—Robert A. Hafer
*Assistant Examiner*—Laura Fossum
*Attorney, Agent, or Firm*—Jeffrey A. Hall

[57] ABSTRACT

A hand-held and manipulated eating toy for simulating eating, chewing, swallowing and discharge of objects by finger and thumb manipulation of a fabric mouth and throat, comprises a toy figure, which may be an animal, dinosaur, imaginary type figure, or the like, includes a mouth forming area with an introducing aperture and a discharge forming area with a discharge aperture. An inner fabric pouch is secured within the toy figure and has a first opening at a top end and a second opening at a bottom end. The first opening is positioned in the mouth forming area of the toy figure and the second opening is positioned in the discharge forming area of the toy figure. The second opening has mating pieces of hook and loop fastening material secured thereto for closure of the second opening. The inner fabric pouch is irregularly configured and has a bottom tapered base portion and a broadened portion secured to the bottom tapered base portion. The broadened portion curves inwardly at an upper portion to form a curved indentation. A curved expanded top portion borders the curved indentation. The curved expanded top portion has a curved upper surface and a flap element adapted and sized for receiving a user's finger tips therein. A front surface which may be gathered and a substantially flat back Surface define a hollow central channel.

14 Claims, 2 Drawing Sheets

HAND MANIPULATED EATING TOY

BACKGROUND OF THE INVENTION

1. Field of Invention

This invention relates to hand held learning toys, and more particularly to hand manipulated eating and swallowing toys for development of hand and eye coordination and related pre-reading skills.

2. Description of the Related Art

Various hand manipulated toys have been proposed and implemented such as puppets, toy animal figures, stuffed animals and the like. Within this genre of toys, numerous designs and functionality's have been proposed and developed. For example U.S. Pat. No. 2,631,408 issued to Henry, Mar. 17, 1953, U.S. Pat. No. 2,762,163 issued to Stein, Sep. 11, 1956, U.S. Pat. No. 1,028,068 issued to Hamely, May 28, 1912, U.S. Pat. No. 5,580,292 issued to Gaportsin Dec. 3, 1996. While such disclosures show hand manipulated toys no patents or prior toys known to applicant disclose a hand manipulated toy which can simulate eating movements such as biting, chewing, swallowing and discharge of an object.

Accordingly, it is the primary object of this invention to provide a hand manipulated eating toy for the development of hand and eye coordination, shape recognition, enjoyment and recreation. The toy of the present invention is safe, sturdy, and is manipulated by using only the hand to control the fabric mouth and throat regions through finger and thumb manipulation which mimics biting, chewing, swallowing and discharge of an object. The present invention is both fun and educational for children to use, while teaching and developing pre-reading skills such as hand and eye coordination and object recognition.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a hand-held and manipulated eating toy for simulating eating, chewing, swallowing and discharge of objects by finger and thumb manipulation of a fabric mouth and throat is provided, comprising a toy figure, which may be an animal, bird, dinosaur, imaginary type figure, or the like, has a mouth forming area with an introducing aperture and a discharge forming area with a discharge aperture. An inner fabric pouch is secured within The toy figure and has a first opening at a top end and a second opening at a bottom end. The first opening is positioned in the mouth forming area of the toy figure and the second opening is positioned in the discharge forming area of the toy figure. The second opening has mating pieces of hook and loop fastening material secured thereto for closure of the second opening. The inner fabric pouch is irregularly configured and has a bottom tapered base portion and a broadened portion secured to the bottom tapered base portion. The broadened portion curves inwardly at an upper portion to form a curved indentation. A curved expanded top portion borders the curved indentation. The curved expanded top portion has a curved upper surface and a flap element adapted and sized for receiving a user's finger tips therein. A front surface which may be gathered and a substantially flat back surface define a hollow central channel.

The hand manipulated eating toy of the present invention may be provided as any animal, bird, dinosaur or imaginary type figure and sized as desired. The toy figure and inner pouch may be composed any durable resilient material, with hemp being preferred.

The present invention is configured to provide a very fun and interesting learning toy. The toy of the present invention is easily used by children or adults and provides interesting and fun entertainment while developing hand and eye coordination, shape recognition, and related skills.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Figure 1:
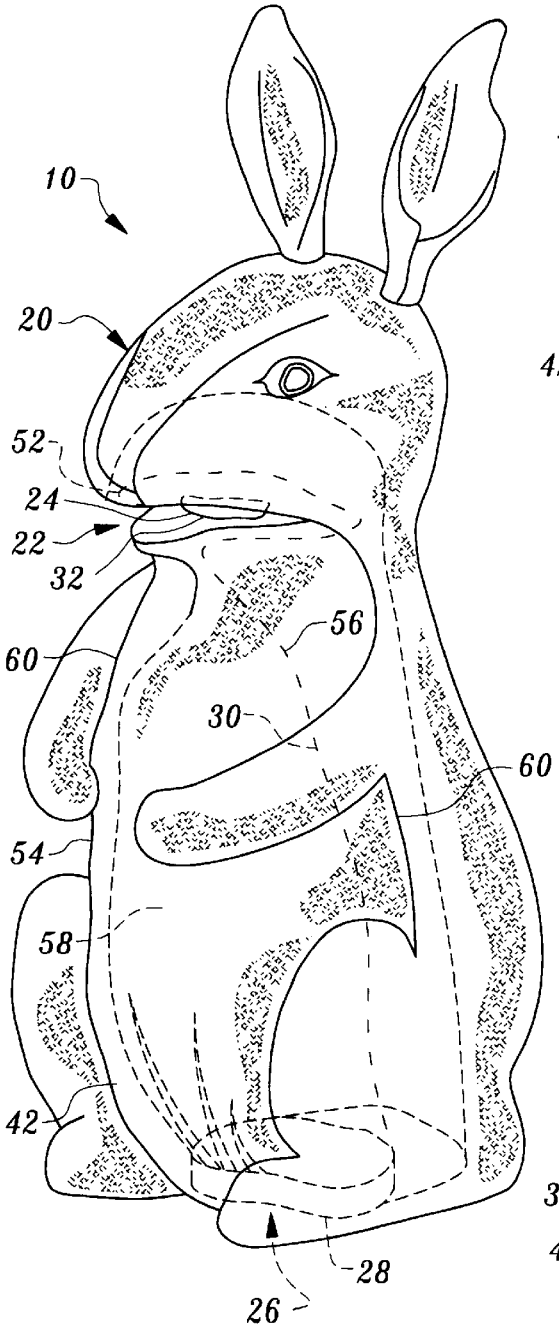
FIG. 1 is a front perspective view of a hand manipulated eating toy, according to the invention.

Reference will now be made in detail to the present preferred embodiments of the invention as illustrated in the accompanying drawings.

In accordance with the present invention, there is provided in a preferred embodiment of the invention, a hand-held and manipulated eating toy for simulating eating, chewing, swallowing and discharge of objects by finger and thumb manipulation of a fabric mouth and throat, comprises a toy figure, which may be an animal, dinosaur, imaginary type figure, or the like, has a mouth forming area with an introducing aperture and a discharge forming area with a discharge aperture. An inner fabric pouch is secured within the toy figure and has a first opening at a top end and a second opening at a bottom end. The first opening is positioned in the mouth forming area of the toy figure and the second opening is positioned in the discharge forming area of the toy figure. The second opening has mating pieces of hook and loop fastening material secured thereto for closure of the second opening. The inner fabric pouch is irregularly configured and has a bottom tapered base portion and a broadened portion secured to the bottom tapered base portion. The broadened portion curves inwardly at an upper portion to form a curved indentation. A curved expanded top portion borders the curved indentation. The curved expanded top portion has a curved upper surface and a flap element adapted and sized for receiving a user's finger tips therein. A front surface which may be gathered and a substantially flat back surface define a hollow central channel.

In accordance with the present invention, there is also provided an improved eating toy of the type in which a hand manipulated toy figure includes a mouth forming area with an introducing aperture and a discharge forming area with a discharge aperture, the improvement comprising: an inner fabric pouch, the inner fabric pouch having a first opening at a top end and a second opening at a bottom end, the first opening being positioned in the mouth forming area of the toy figure and the second opening being positioned in the discharge forming area of the toy figure; the second opening having mating pieces of hook and loop fastening material secured thereto for closure of the second opening; the inner fabric pouch being irregularly configured and having a bottom tapered base portion, a broadened portion secured to the bottom tapered base portion, the broadened portion curving inwardly at an upper portion to form a curved indentation; a curved expanded top portion integral with the curved indentation, the curved expanded top portion having a curved upper surface and a flap element adapted and sized for receiving a user's finger tips therein; a front surface and a substantially flat back surface, and a hollow central channel being defined by the front surface and the back surface, whereby hand manipulation of the inner pouch allows for simulating eating, chewing, swallowing and discharge of objects by finger and thumb manipulation of the inner pouch.

Figure 3:
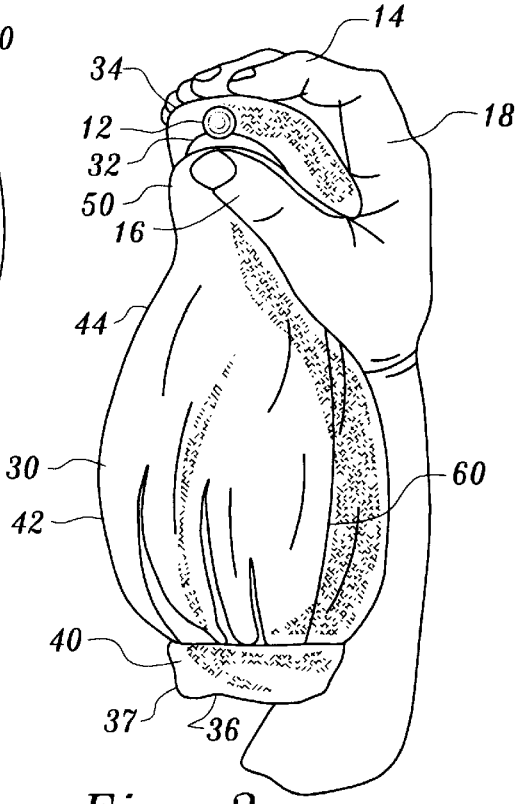
FIG. 3, is a side perspective view of the inner pouch of such hand manipulated eating toy showing the positioning of a users hand for simulating eating by such toy, according to the invention.

In FIGS. 1 and 3, a hand manipulated eating toy 10 for simulating eating, chewing, swallowing and discharge of objects 12 by the movements of a user's finger 14 and thumb 16 of hand 18, is shown. The eating movements are accomplished by manipulation of a fabric mouth and throat of toy 10. Toy 10 preferably comprises a toy figure 20, shown as a rabbit, however any other type of animal, bird, dinosaur, snake, fish, or imaginary creature may be used. The toy figure 20 is provided with a mouth forming area 22 with an introducing aperture 24 and a discharge forming area 26 with a discharge aperture 28.

Figure 2:
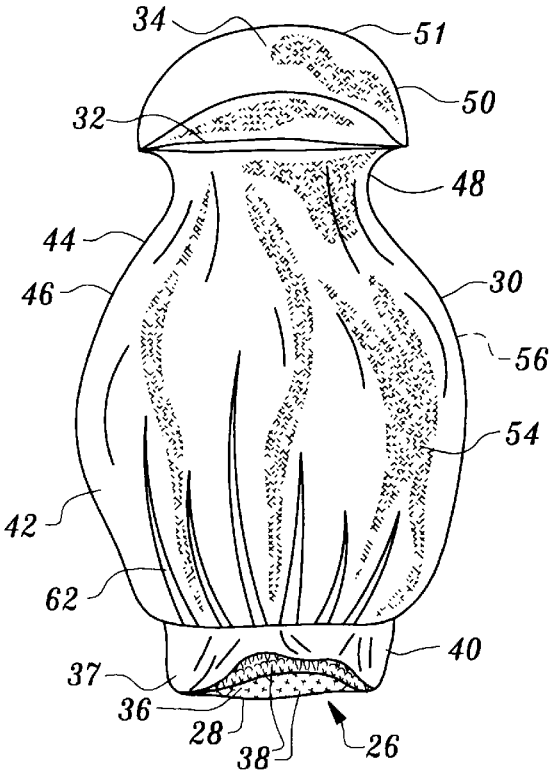
FIG. 2 is a perspective view of the inner pouch of such hand manipulated eating toy, according to the invention.

Seen in FIGS. 1, 2, and 3, an inner fabric pouch 30, has a first opening 32 at a top end 34 and a second opening 36 at a bottom end 37. The first opening 32 is preferably positioned in the mouth forming area 22 of the toy figure 20 and the second opening 36 positioned in the discharge forming area 26 of the toy figure 20. The inner pouch is preferably secured therein by stitches 60, but ray be otherwise attached by clamps, rings, or other fastening device if desired. In the preferred embodiment, second opening 36 has mating pieces of hook and loop fastening material 38 secured thereto for closure of the second opening.

The inner fabric pouch 30 is preferably composed of a durable resilient material, such as hemp, cotton, nylon, or the like, with hemp being preferred. Inner fabric pouch 30 is irregularly configured and has a bottom tapered base portion 40. A broadened portion 42 is secured bottom tapered base portion 40. The broadened portion 42 curves inwardly 44 at an upper portion 46 to form a curved indentation 48. A curved expanded top portion 50 is connected with the curved indentation 48.

Figure 4:
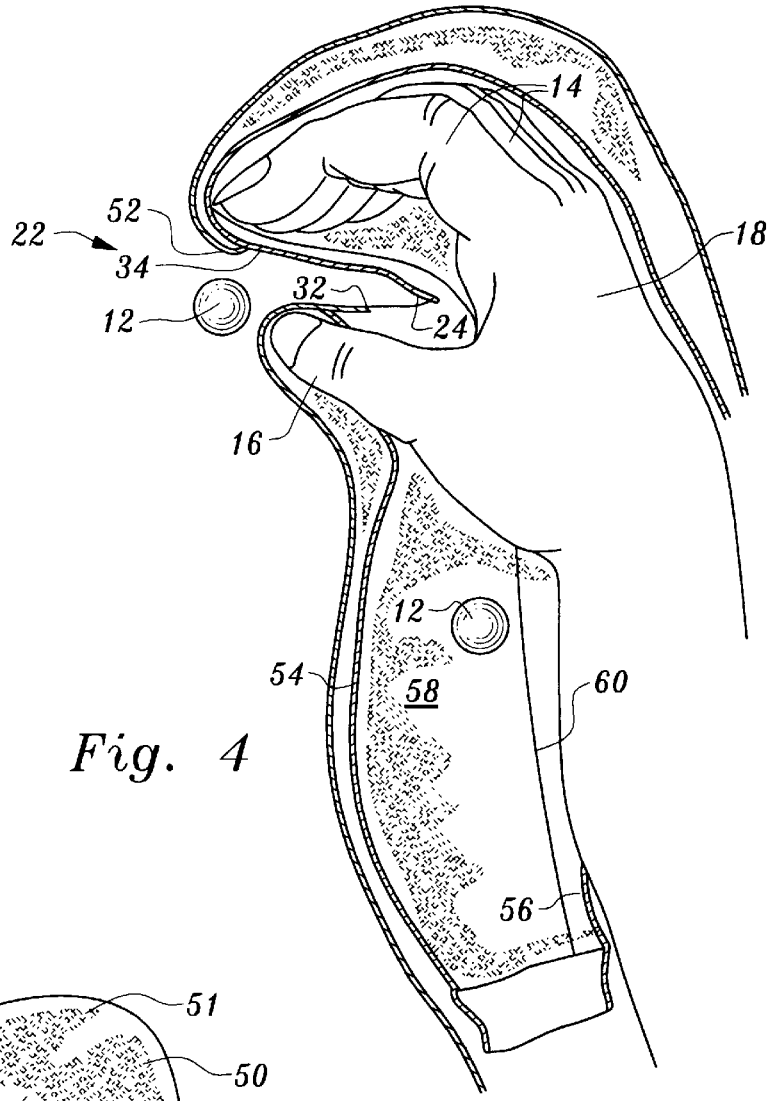
FIG. 4, is a exploded view of the flap element of said inner pouch of said toy adapted and sized to receive a user's fingers, according to the invention.
Figure 5:
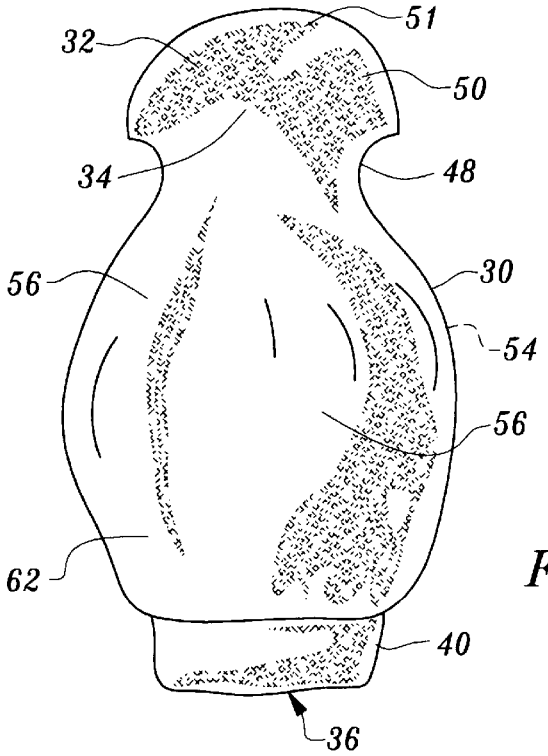
FIG. 5, is a rear view of the inner pouch of such toy according to the invention.

Best seen in FIG. 4, the curved expanded top portion 50 has a curved upper surface 51 and a flap element 52 adapted and sized for receiving a user's finger tips therein. The flap element 52 is preferably positioned in the mouth forming area 22 providing the user's fingers with a secure grip while allowing the user's thumb to move about freely to move objects down inner pouch 30.

In FIGS. 1 and 3, a front surface 54 which may include a gathered portion 62 of inner pouch 30 is shown. Gathered portion 62 is provided for extra "food" space in toy 10. In FIG. 2 a back surface 56 of inner pouch 30, which preferably is substantially flat is shown. A hollow central channel 58 is defined by front surface 54 and back surface 56 with first opening 32 at the top end and second opening 37 at the bottom end of channel 58.

In operation and use hand manipulated eating toy 10 is very educational, safe, easy to use, reliable, and effective for the development of pre-reading skills such as hand and eye coordination, shape recognition, and the like. As seen in FIG. 2, inner fabric pouch 30 has apertures 32 at top end 34 and aperture 36 at bottom end 37 and is constructed to hold "food". Hook and loop fastening closures 38 at second opening 36 allow for the toy to both retain "food" if closed or discharge "food" if open.

Referring now to FIG. 3, hand 18 is shown positioned on inner pouch 30. In use, typically a user would slip his or her hand over the top end 34 and mouth forming region 22, and position the thumb under the curved expanded portion 50 which corresponds to the mouth area of the toy, and "food" particles, which may be any object are then hand and thumb manipulated into central channel 58 of inner fabric pouch 30. The flap element 52, best seen in FIG. 4, is configured for securing the user's fingers therein, so that the user's fingers have more grip using the space provided by flap element 52. This allows the user's thumb to move about freely, moving "food" objects down into inner fabric pouch 30.

Basic food eating motions and behavior are accurately rendered by toy 10. For example, biting actions are accomplished by sliding the hand into the inner fabric pouch 30 of toy 10. Preferably the user's fingers are positioned into flap element 52 and near the corner of mouth forming area 22. The user's thumb is then slid around and onto the curved expanded portion 50 which generally corresponds to the chin of the toy. Chewing motions are made by using the thumb to work "food" objects into the mouth forming area 22 and into central channel 58, which corresponds to the throat area of the toy. Swallowing movements are made by using the thumb to move the "food" objects through central channel 58 towards bottom end 37. Discharge of "food" objects is accomplished by opening the hook and loop fastening material 38 thereby opening second opening 36.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A hand manipulated eating toy for simulating eating, chewing, swallowing and discharge of objects by finger and thumb manipulation of a fabric mouth and throat, comprising:

a toy figure including a head having a fabric mouth and throat, a torso portion, and a lower body portion, the lower body portion having a discharge aperture accessing a hollow central channel extending through the lower body portion, torso, and head of the toy figure, the mouth of the toy figure further including an introducing aperture sized to receive small objects to simulate eating;

an inner fabric pouch positioned within the toy figure, said inner fabric pouch having a first opening at a top end and a second opening at a bottom end, said first opening being positioned adjacent said mouth communicating with said introducing aperture and said second opening being positioned within said lower body portion communicating with said discharge aperture, said second opening having mating pieces of hook and loop fastening material secured thereto for closure of said second opening;

said inner pouch being irregularly configured and having a bottom tapered base portion, a broadened portion secured to said bottom tapered base portion, said broadened portion curving inwardly at an upper portion to form a curved indentation, a curved expanded top portion integral with said curved indentation, said curved expanded top portion having a curved upper surface and a flap element adapted and sized for receiving a user's finger tips therein; and wherein said toy figure is dimensioned and arranged to receive both a user's hand and said inner fabric pouch within said hollow central channel such that the user's hand extends through the discharge aperture, lower body portion, torso, and head adjacent said inner pouch, and the finger tips of the user's hand grasp and manipulate the top end of the inner pouch to cause the mouth to simulate eating, chewing, shallowing.

2. The hand manipulated eating toy of claim 1, wherein said inner fabric pouch is sewn into said toy figure.

3. The hand manipulated eating toy of claim 1, wherein said broadened portion includes a gathered portion in proximity to said bottom tapered portion.

4. The hand manipulated eating toy of claim 1, wherein said toy figure is composed of a durable resilient material.

5. The hand manipulated eating toy of claim 1, wherein said toy figure is composed of hemp.

6. The hand manipulated eating toy of claim 1, wherein said toy figure is an animal.

7. The hand manipulated eating toy of claim 1, wherein said toy figure is a rabbit.

8. An improved hand manipulated eating toy of the type in which a hand manipulated toy figure includes a head having a mouth and throat, a torso portion, and a lower body portion, the lower body portion having a discharge aperture accessing a hollow central channel extending through the lower body portion, torso, and head of the toy figure, the mouth of the toy figure further including an introducing aperture sized to receive small objects to simulate eating; the improvement comprising:

an inner fabric pouch positioned within the toy figure, said inner fabric pouch having a first opening at a top end and a second opening at a bottom end, said first opening being positioned adjacent said mouth communicating with said introducing aperture and said second opening being positioned within said lower body portion communicating with said discharge aperture, said second opening having mating pieces of hook and loop fastening material secured thereto for closure of said second opening;

said inner pouch being irregularly configured and having a bottom tapered base portion, a broadened portion secured to said bottom tapered base portion, said broadened portion curving inwardly at an upper portion to form a curved indentation, a curved expanded top portion integral with said curved indentation, said curved expanded top portion having a curved upper surface and a flap element adapted and sized for receiving a user's finger tips therein; and wherein said toy figure is dimensioned and arranged to receive both a user's hand and said inner fabric pouch within said hollow central channel such that the user's hand extends through the discharge aperture, lower body portion, torso, and head adjacent said inner pouch, and the finger tips of the user's hand grasp and manipulate the top end of the inner pouch to cause the mouth to simulate eating, chewing, shallowing.

9. The improved eating toy of claim 8, wherein said inner fabric pouch is sewn into said toy figure.

10. The improved eating toy of claim 8, wherein said broadened portion includes a gathered portion in proximity to said bottom tapered portion.

11. The improved eating toy of claim 8, wherein said toy figure is composed of a durable resilient material.

12. The improved eating toy of claim 8, wherein said toy figure is composed of hemp.

13. The improved eating toy of claim 8, wherein said toy figure is an animal.

14. The improved eating toy of claim 8, wherein said toy figure is a rabbit.

* * * * *